United States Patent [19]

Fukuroi et al.

[11] 4,337,631

[45] Jul. 6, 1982

[54] APPARATUS FOR TREATMENT OF MATERIALS

[75] Inventors: Akio Fukuroi, Uozu; Isao Sugimoto, Aichi, both of Japan

[73] Assignees: Yoshida Kogyo K.K.; Nippon Dyeing Mfg. Co., both of Tokyo, Japan

[21] Appl. No.: 249,389

[22] Filed: Mar. 31, 1981

[30] Foreign Application Priority Data

Mar. 31, 1980 [JP] Japan ..... 55-41421[U]

[51] Int. Cl.[3] ..... D06B 5/18

[52] U.S. Cl. ..... 68/189

[58] Field of Search ..... 68/189

[56] References Cited

U.S. PATENT DOCUMENTS 4,206,619 6/1980 Fukuroi et al. ..... 68/189 X 4,217,768 8/1980 Sugimoto ..... 68/189 X

*Primary Examiner*—Philip R. Coe

*Attorney, Agent, or Firm*—Bucknam and Archer

[57] ABSTRACT

An apparatus for the treatment of materials has a series of beams connected end to end and supported concentrically within a cylindrical vessel, the materials to be treated being wound on the individual beams. The vessel has an inlet at its one end for introduction of treatment liquid, a plurality of first outlets at its bottom for discharging a portion of the treatment liquid out of the vessel, and at least one second outlet at its top for discharging the remaining treatment liquid out of the vessel. Each first outlet is located centrally of one of the beams, and the second outlet is radially aligned with a joint between an adjacent pair of the beams. A pressure-control tank is disposed above the vessel and extends substantially through the length thereof. The tank is connected to the vessel by a plurality of connection pipes for liquid communication therebetween, the connection pipes being spaced apart from one another substantially at regular distances along the vessel. At least one of the connection pipes is radially aligned with the second outlet that is radially aligned with a joint between an adajcent pair of the beams.

5 Claims, 3 Drawing Figures

APPARATUS FOR TREATMENT OF MATERIALS

BACKGROUND OF THE INVENTION

1. Field of the Invention

The present invention relates to apparatus for the treatment of materials, such as textiles, with treatment liquid.

Any operations which are carried out in an aqueous medium and which are applied to textiles, as is the case in treatments involving degreasing, desizing, removing transient colours and dyeing, as well as the operations which follow the above, such as greasing, the imparting of water-repellent characteristics, flameproofing, and the imparting of anti-static characteristics, are defined by the term "treatment".

2. Prior Art

There are known a number of apparatus for forcing treatment liquid such as dyeing, bleaching and other media into and through textile materials such as yarns, tapes and other fabrics that are wound on a perforated cylindrical tube commonly know as "beam." The perforated cylindrical tube is supported concentrically within a cylindrical vessel. The treatment liquid is forced, under high pressure and at high temperature, to penetrate the layers of material outwardly radially from inside of the beam on which the material is wound or wrapped. Difficulty has been experienced with many of the prior art apparatus in securing uniformity of treatment in all portions of the material often resulting in different shades and/or hues both radially and axially of the roll of material.

To eliminate such uneven treatments, it has been proposed, as disclosed in U.S. Pat. No. 4,206,619, to provide the cylindrical vessel with an upper outlet in addition to a lower outlet located beneath the beam centrally thereof. The upper outlet is disposed at the top of the vessel adjacent to the front end of the beam which end is remote from the inlet of the vessel. The treatment liquid from the upper outlet is discharged out of the vessel via an annular jacket mounted on the vessel. Such a prior apparatus has not been so practical particularly when employed in an apparatus having a series of beams for supporting the materials to be treated. This is because providing the vessel with a plurality of upper outlets, one for each beam, makes the apparatus complex and hence expensive. The present invention is an improvement on this prior art.

SUMMARY OF THE INVENTION

A plurality of perforated hollow beams, for supporting materials to be treated, are joined end to end and supported concentrically within a cylindrical vessel through which treatment liquid is circulated. The vessel has a plurality of first outlets at its bottom, each disposed centrally of one of the beams, and at least one second outlet at its top. The second outlet is radially aligned with a joint between an adjacent pair of the beams. A pressure-control tank, for controlling liquid pressure in the vessel, is disposed above the vessel and extends substantially through the length thereof. The tank is connected to the vessel by a plurality of connection pipes for liquid communication therebetween, the connection pipes being spaced apart from one another substantially at regular distances along the vessel. At least one of the connection pipe is radially aligned with the second outlet that is radially aligned with a joint between an adjacent pair of the beams. With such an arrangement it is possible to force treatment liquid into and through the materials homogeneously and uniformly throughout all the beams without making the apparatus complex.

Accordingly, it is an object of the present invention to provide an improvement of apparatus for the treatment of materials which has a series of perforated hollow beams connected end to end.

Another object of the invention is to provide such an apparatus which enables a uniformity and equalization of liquid flow throughout the elongate beam assembly, making the materials on the individual beams to be treated homogeneously and uniformly.

Still another object of the invention is to provide such an apparatus which enables to reduce the number of upper outlets and thus jackets to a minimum.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION OF THE PREFERRED EMBODIMENT

Figure 1:
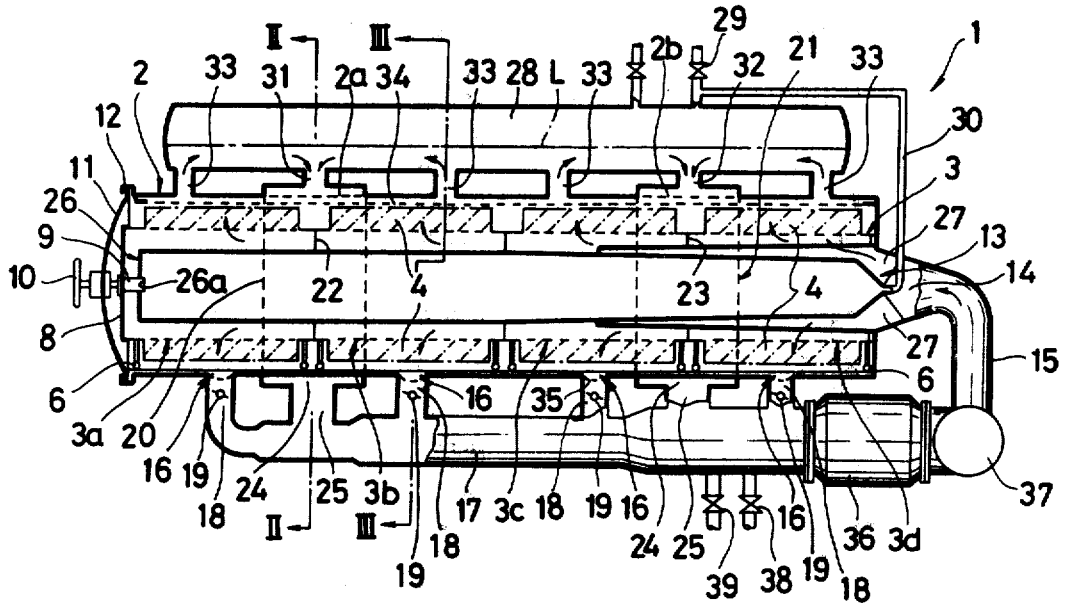
FIG. 1 is a schematic longitudinal cross-sectional view of an apparatus according to the present invention.
Figure 2:
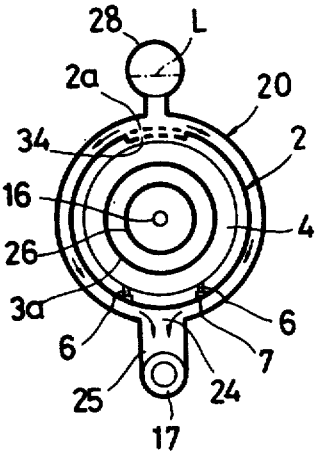
FIG. 2 is a schematic transverse cross-sectional view taken along section line II—II of FIG. 1.
Figure 3:
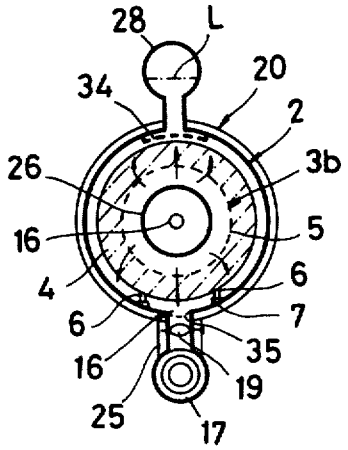
FIG. 3 is a schematic transverse cross-sectional view taken along section line III—III of FIG. 1.

FIG. 1 shows an apparatus 1 for the treatment of materials 4 such as textiles (hereinafter referred to as "materials"). The apparatus 1 includes a cylindrical vessel 2 having a generally circular transverse cross-section (FIGS. 2 and 3) and extending along a generally horizontal axis. The vessel 2 has one or front end (11), which is removable for a purpose described below. A series of first, second, third, and fourth perforated hollow beams *3a,3b,3c,3d* are supported within the vessel 2 and connected end to end to jointly constitute an elongate beam assembly 3. Each of the beams *3a,3b,3c,3d* is capable to support the material 4 to be treated, the material 4 being wound on the exterior of the beam. Each beam *3a,3b,3c,3d* has a multiplicity of perforations 5 (FIG. 3) formed in the periphery of the beam and distributed uniformly therearound, allowing treatment liquid to flow into and through the material 4 wound on the beam.

Each beam *3a,3b,3c,3d* further has a pair of rollers 6.6 at each end which are movably mounted on a pair of parallel spaced rails 7,7 secured to and extending longitudinally of the vessel 2.

A lid or cover 8 is provided which is centrally engaged with a rod 9 connected to a hand-operated wheel 10. Rotating this wheel 10 in one direction clamps the lid 8 to sealingly close one or front end of the beam assembly 3, i.e. one or front end of the first beam *3a*, and in the opposite direction then releases the lid 8 to permit the removal of the beams *3a,3b,3c,3d* out of vessel 2 when a cycle of the treatment operations has been completed.

A cap 11, which constitutes the front end of the vessel 2, is threadedly engaged with the rod 9 and removably connected to the vessel 2 by means of a clamping ring 12. At the other or rear end, the vessel 2 has an inlet 13 to which a flared end 14 of a first pipeline 15 is connected for introducing the treatment liquid into the vessel 2 through the inlet 13. The other or rear end of the beam assembly 3, i.e. one or rear end of the fourth beam 3*d*, is removably fitted circumferentially to the inlet 13 of the vessel 2 or the flared end 14 of the first pipeline 15.

The vessel 2 has in its bottom portion a plurality of first or lower outlets 16 each located substantially centrally of one of the beams 3*a*,3*b*,3*c*,3*d* and communicating with a second pipeline 17 via a first flow take-out pipe 18. The treatment liquid from the vessel 2 is withdrawn partly through the first flow take-out pipes 18 to the second pipeline 17 for circulation as described below. A control valve 19 is disposed in each first flow take-out pipe 18 for controlling the rate of liquid flow through the corresponding first outlet 16 to the second pipeline 2.

A pair of annular flow take-out jackets 20,21 is mounted on and around the vessel 2. The two jackets 20,21 are spaced apart from one another along the vessel 2 and radially aligned, respectively, with a joint 22 between the first and second beams 3*a*,3*b* and a joint 23 between the third and fourth beams 3*c*,3*d*. Each jacket 20,21 has in its bottom a third outlet 24,24 communicating with the second pipeline 17 via a second flow take-out pipe 25,25. The upper portions 2*a*,2*b* of the vessel 2 which register radially with the jackets 20,21, respectively, are perforated to provide a pair of second or upper outlets. Accordingly, the treatment liquid from the vessel 2 is withdrawn to the second pipeline 17 partly via the jackets 20,21 and thus the second flow take-out pipes 25,25.

An elongate dummy cylinder 26 is supported within the vessel 2, by means of a pair of support members 27,27, in order to reduce the volume within the vessel 2, thereby minimizing the amount of treatment liquid that is required to be contained in the vessel 2. The dummy cylinder 26 is positioned concentrically of and within the beam assembly 3 to define therewith an annular flow passage for the treatment liquid. The dummy cylinder 26 has at one end or front end an axial recess 26*a*, in which a free end of the rod 9 is removably fitted.

A pressure-control tank 28 is installed above the vessel 2 for storing compressed air supplied from a suitable source (not shown) via a valve 29 and for supplying the same to the dummy cylinder 26 through a pipe 30. A pair of first connection pipes 31,32 is connected at one end to the bottom of the tank 28 and at the other end to the jackets 20,21 at positions radially aligned with the second outlets 2*a*,2*b*, respectively. A plurality of second connection pipes 33 are connected at one end to the bottom of the tank 28 and at the other end to the top of the vessel 2 at positions radially out of alignment with the jackets 20,21. Thus liquid communication between the tank 28 and the vessel 2 is provided.

Preferably, the first and second connection pipes 31,32,33 are spaced apart from one another substantially at regular distances along the vessel 2.

A perforated flow-rectifying panel 34 is supported within the vessel 2 and extends over and parallel to the top of the beam assembly 3 through the length of the vessel 2 to define with the inner wall thereof a flow-rectifying chamber (unnumbered). The panel 34 has a perforated semi-cylindrical portion coextending longitudinally with the perforated walls of the beams 3*a*,3*b*,3*c*,3*d* and circumferentially with the perforated upper portions 2*a*,2*b* (second outlets) of the vessel 2. A plurality of perforated, outwardly convex panels 35 are disposed one at each of the first outlets 16. With such perforated panels and portions, liquid flow within the apparatus is uniformed or equalized.

The second pipeline 17, for withdrawing treatment liquid from the vessel 2, is connected to a heat exchanger 36 by which treatment liquid is maintained at a predetermined temperature. A motor-driven pump 37 is connected at its suction side to the heat exchanger 36 and its discharge side to the first pipeline 15.

In operation, the apparatus 1 is filled with treatment liquid such that the level of liquid in the tank is at a predetermined level L, the liquid being supplied from a source (not shown) via a valve 38. As the liquid in the apparatus 1 is circulated by the pump 37 under a predetermined air pressure, the liquid from the second pipeline 17 is introduced into the interior of the beam assembly 3 via the first pipeline 15 and then the inlet 13 of the vessel 2. The liquid is then forced radially outwardly through the perforated walls of the beams 3*a*,3*b*,3*c*,3*d* and into and through the layers of the materials 4 wound thereon. After that, the liquid is withdrawn out of the vessel 2, at which time a portion of the liquid passes upwardly through the perforated flow-rectifying panel 34 and through the perforated upper portions (or upper outlets) 2*a*,2*b* of the vessel 2 into the jackets 20,21 and thence into the second pipeline 17 via the second flow take-out pipes 25,25. The remaining portion of the liquid passes downwardly through the perforated convex panels 35 at the corresponding lower outlets 16 of the vessel 2 and through the first flow take-out pipes 18 into the second pipeline 17. Designated at 39 is a drainage valve for draining used treatment liquid.

It has been found that uniform and efficient treatment of the material 4 can be achieved by regulating the flow of liquid through the first flow take-out pipes 18 to be preferably in the range of one-third ($\frac{1}{3}$) to four-fifths (4/5) of the total liquid flow to be discharged out of the vessel 2. Such a flow regulation can be accomplished by controlling the individual control valves 19. In addition, if the individual control valves 19 are controlled such that the partial flow of liquid through the individual first flow take-out pipes 18 increases gradually from the pipe adjacent to the inlet 13 of the vessel 2 to the pipe remote therefrom, the flow of liquid that passes through the lower half of the materials 4 wound on the individual beams 3*a*,3*b*,3*c*,3*d* will be equalized.

The flow of liquid having passed through the upper half of the materials 4 on the individual beams 3*a*,3*b*,3*c*,3*d* is distributed, by the perforated flow-rectifying panel 34, uniformly through the length of the vessel 2. A portion of this liquid flow passes upwardly through the second connection pipes 33 into the pressure-control tank 28 and then downwardly through the first connection pipes 31,32 into the jackets 20,21. A uniformity and equalization of liquid flow for the upper half of the material 4 on the individual beams 3*a*,3*b*,3*c*,3*d* is thus effected. The liquid flow then returns to the second pipeline 17 via the second flow take-out pipes 25,25.

The liquid withdrawn out of the vessel 2 into the second pipeline 17 is transferred to the heat exchanger 36 and then forced by the pump 37 into the vessel 2 via the first pipeline 15.

In the apparatus 1 foams developed or built up in the treatment liquid during the treatment operations will be easily eliminated or appreciably reduced while the liquid flow containing such foams is moving around in the pressure-control tank 28, preventing the material 4 from being unevenly treated.

Although various minor modifications may be suggested by those versed in the art, it should be understood that we wish to embody within the scope of the patent warranted hereon, all such embodiments as reasonably and properly come within the scope of our contribution to the art.

What is claimed is:

1. An apparatus for the treatment of materials with treatment liquid, comprising:

(a) a horizontally extending elongate cylindrical vessel of generally circular cross section for containing the treatment liquid;

(b) a plurality of perforated hollow beams connected end to end and supported concentrically within said vessel for supporting on and around said beams the materials to be treated;

(c) said vessel having an inlet at its one end for introducing the treatment liquid into said vessel, a plurality of first outlets at its bottom for discharging a portion of the treatment liquid out of said vessel, and at least one second outlet at its top for discharging the remaining portion of the treatment liquid out of said vessel, each of said first outlets being disposed substantially centrally of one of said beams, said second outlet being radially aligned with a joint between an adjacent pair of said beams;

(d) a pressure-control tank disposed above said vessel for controlling liquid pressure in said vessel, said tank coextending longitudinally with said vessel;

(e) a plurality of connection pipes communicating at one end with said tank and at the other end with said vessel, at least one of said connection pipes being radially aligned with said second outlet, the other connection pipes being spaced apart from adjacent joints of said beams longitudinally along said vessel; and (f) means for supplying and circulating the treatment liquid through said vessel and said tank.

2. An apparatus according to claim 1, said connection pipes being spaced apart from one another at substantially regular distances along said vessel.

3. An apparatus according to claim 1, further including a perforated flow-rectifying panel supported within said vessel and extending over said beams through the length of said vessel.

4. An apparatus according to claim 1, further including at least one annular flow take-out jacket mounted on and around said vessel and communicating at its upper portion with said second outlet and having at its bottom a third outlet opening to said supplying and circulating means, whereby the treatment liquid from said second outlet is discharged out of said vessel into said supplying and circulating means via said jacket.

5. An apparatus according to claim 1, wherein said vessel has a plurality of said second outlets disposed at positions radially aligned with every other joint of said beams.

* * * * *